US006612132B2

(12) United States Patent
Kimura et al.

(10) Patent No.: US 6,612,132 B2
(45) Date of Patent: Sep. 2, 2003

(54) GRAVITY BALANCING RING

(76) Inventors: Tosihiko Kimura, No. 202, 1-33-7, Kichijoji Honmachi, Musashino-shi, Tokyo (JP); Yoshimitsu Kusano, 2-18-1, Toushin cho, Itabashi ku, Tokyo (JP)

( * ) Notice: Subject to any disclaimer, the term of this patent is extended or adjusted under 35 U.S.C. 154(b) by 0 days.

(21) Appl. No.: 10/015,568

(22) Filed: Dec. 17, 2001

(65) Prior Publication Data

US 2003/0110797 A1 Jun. 19, 2003

(51) Int. Cl.[7] ..... A44C 17/02
(52) U.S. Cl. ..... 63/31; 63/15; 63/26; 63/29.1
(58) Field of Search ..... 63/15, 26, 29.1, 63/31

(56) References Cited

U.S. PATENT DOCUMENTS 915,678 A * 3/1909 Kantor et al. ..... 63/31
922,212 A * 5/1909 Tropin ..... 63/31
3,081,997 A * 3/1963 Glass et al. ..... 472/70
4,187,697 A * 2/1980 Castelo ..... 63/31
4,220,017 A * 9/1980 Freeman ..... 63/15
4,726,200 A * 2/1988 Carter ..... 63/15
4,977,757 A * 12/1990 Mesica et al. ..... 63/15
5,787,731 A * 8/1998 Ebara ..... 63/29.1
5,950,456 A * 9/1999 Kirsch, Jr. ..... 63/31

* cited by examiner

*Primary Examiner*—Andrea Chop
(74) *Attorney, Agent, or Firm*—Armstrong, Westerman & Hattori, LLP

(57) ABSTRACT

A ring body fitted around a finger and a collet for supporting and fixing a stone are constituted of separate members, wherein the collet is positioned between two support members erected on the ring body and is oscillatably supported by loosely fitting struts projecting outward from opposite outer surfaces of the collet and coaxially with each other into bearing holes formed at facing side surfaces of the support members, respectively, and further, the positions of the struts are selected in such a manner that an oscillatory center (x) is located nearer the front side of the stone than the center of gravity of a movable unit consisting of the stone and the collet.

6 Claims, 4 Drawing Sheets

GRAVITY BALANCING RING

BACKGROUND OF THE INVENTION

1. Field of the Invention

The present invention relates to a ring.

2. Description of the Related Art

A stone of a ring has been conventionally fixed to a ring body via a collet disposed at a part of the ring body. Since in this type of ring, the stone is designed to sparkle in the light from mainly the front side thereof, there has arisen a problem that the stone cannot sparkle sufficiently if a finger is tilted and the front side of the stone is hidden. Furthermore, in comparison with a necklace or the like which is loosely fitted to a human body, no free motion can be produced since the stone is fixed to the collet in the ring, thereby arising a problem that decorativeness cannot be satisfactorily exhibited.

SUMMARY OF THE INVENTION

The present invention has been accomplished to solve the above-described problems experienced in the conventional ring. Therefore, an object of the present invention is to provide a ring, in which the front side of a stone hardly disappears even if a finger is tilted, so that the stone can sparkle with increased chances, and further, decorativeness can be represented by a free motion of the stone, like a necklace.

A ring according to the present invention comprises a ring body fitted around a finger and a collet for supporting and fixing a stone, which are constituted of separate members. The collet is positioned between two support members erected on the ring body and is oscillatably supported by loosely fitting struts projecting outward from opposite outer surfaces of the collet and coaxially with each other into bearing holes formed at facing side surfaces of the support members, respectively, and further, the positions of the struts are selected in such a manner that an oscillatory center is located nearer the front side of the stone than the center of gravity of a movable unit consisting of the stone and the collet. Alternatively, the collet may be oscillatably supported by the two support members erected on the ring body by loosely fitting struts projecting inward from the facing side surfaces of the support members and coaxially with each other into bearing holes formed at opposite outer surfaces of the collet for supporting the stone, respectively, and further, the positions of the bearing holes at the collet may be selected in such a manner that an oscillatory center is located nearer the front side of the stone than the center of gravity of a movable unit consisting of the stone and the collet. Preferably, the bearing hole(s) or the strut(s) formed at the facing side surface(s) of either one or both of the two support members should be disposed in such a manner as to be freely advanced or retreated with respect to the support member(s) via a screw(s). It is preferable that the strut should be formed into a conical shape and the collet should be oscillatably supported by a point contact between the strut and the inner surface of the bearing hole.

DESCRIPTION OF THE PREFERRED EMBODIMENTS

Figure 1:
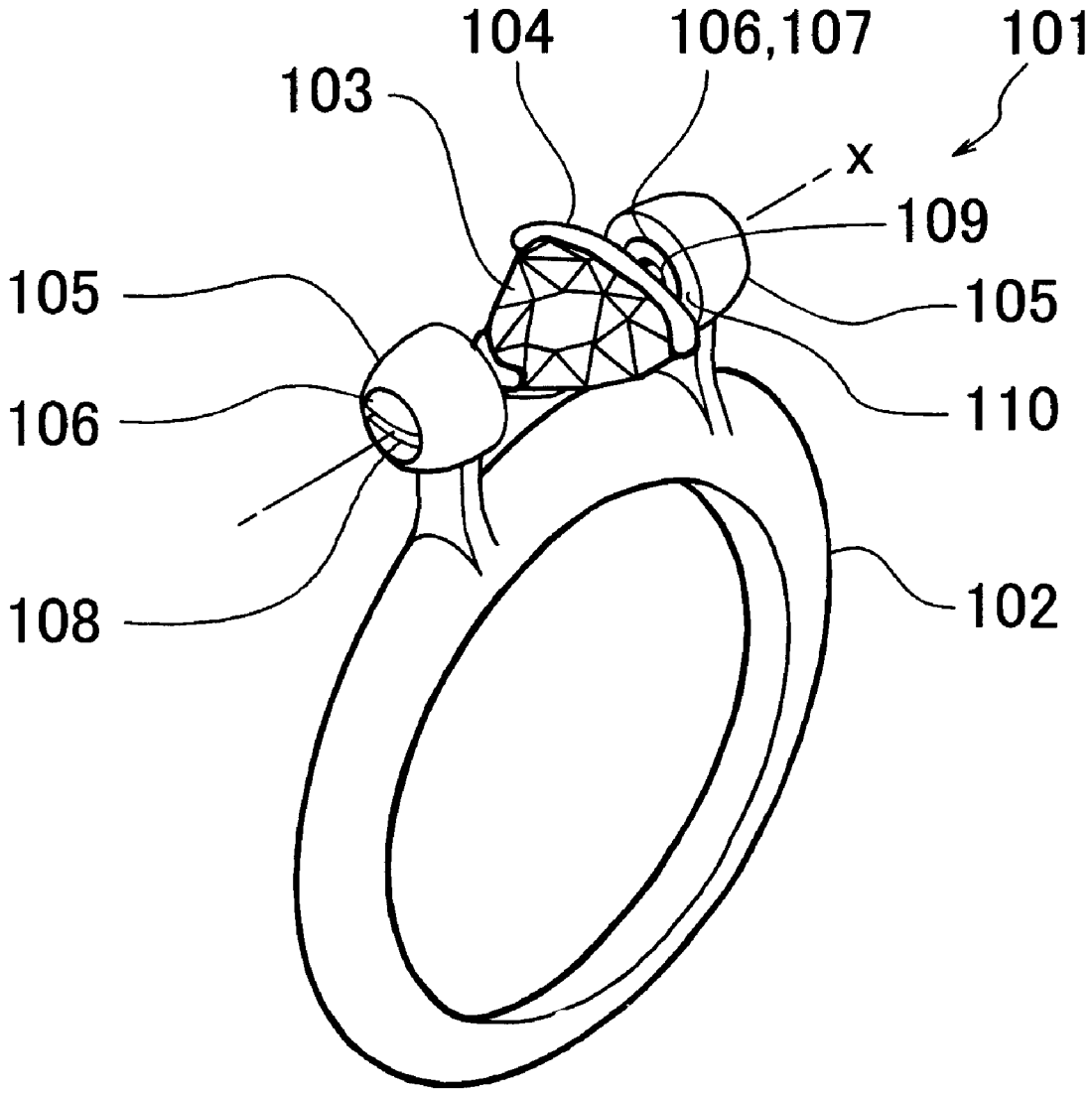
FIG. 1 is a perspective view showing a ring in a first embodiment according to the present invention.

FIGS. 1 to 4 show a ring 101 in a first embodiment according to the present invention. In the drawings, the ring 101 comprises a ring body 102 to be fitted around a finger, a stone 103, and a collet 104 for supporting and fixing the stone 103.

In the ring body 102 are erected two support members 105 and 105, which are provided at the upper ends thereof with screw holes 107 and 107 for screwing therein screws 106 and 106, respectively. The screw holes 107 and 107 are formed on a common virtual axis (x) connecting the two support members 105 and 105 in such a manner as to penetrate through the support members 105 and 105 in the same direction, respectively.

Each of the screws 106 and 106 is a set screw without any head. The screws per se have recesses 108 and 108, and thus, are embedded in the screw holes 107 and 107 when the screws are threaded thereinto. Here, cruciform recesses or hexagonal holes may be formed in place of the recesses 108 and 108. Furthermore, bearing holes 109 and 109 are formed at the respective tips of the screws 106 and 106. When the screws 106 and 106 are threaded into the screw holes 107 and 107, respectively, the bearing holes 109 and 109 are disposed opposite to facing side surfaces 110 and 110 of the support members 105 and 105, respectively.

At opposite outer surfaces of the collet 104, struts 111 and 111 project outward and coaxially with each other. Each of the struts 111 and 111 is formed into a sharp-pointed conical shape. Moreover, the respective vertical positions of the struts 111 and 111 are selected in such a manner that a line connecting the struts 111 and 111 (i.e., an oscillatory axis x) is positioned above the center 112 of the entire gravity, i.e., on the front side of the stone in the state in which the stone 103 is fixed on the collet 104. A distance from the tip of one of the struts 111 and 111 to the tip of the other is substantially the same as an interval between the facing side surfaces 110 and 110 of the support members 105 and 105, although it need not always be the same. For example, the distance is set somewhat longer in the present embodiment.

When the collet 104 having the stone 103 supported and fixed therein is attached to the ring body 102, either one of the two screws 106 and 106 screwed into the screw holes 107 and 107 of the support members 105 and 105 is loosened, and then, is retreated outward of the support member 105 to enlarge the interval between the bearing holes 109 and 109. Thereafter, the struts 111 and 111 of the collet 104 are contained in order inside the bearing holes 109 and 109, respectively. Subsequently, the loosened screw 106 is fastened and advanced toward the other screw 106, and then, the struts 111 and 111 of the collet 104 are held between the bearing holes 109 and 109. Consequently, it is possible to prevent any falling-off of the struts 111 and 111, so that the movable unit consisting of the stone 103 and the collet 104 as a whole can be oscillatably supported between the two support members 105 and 105.

Incidentally, the screws 106 and 106 need not be fastened so much that the respective tips of the struts 111 and 111 abut against the deepest portions of the bearing holes 109 and 109. If the screws 106 and 106 are stopped to be fastened immediately before the tips of the struts 111 and 111 abut against the deepest portions of the bearing holes 109 and 109, the friction between the struts 111 and 111 and the bearing holes 109 and 109 can be reduced, thus facilitating the oscillation of the movable unit (103 and 104).

Figure 4:
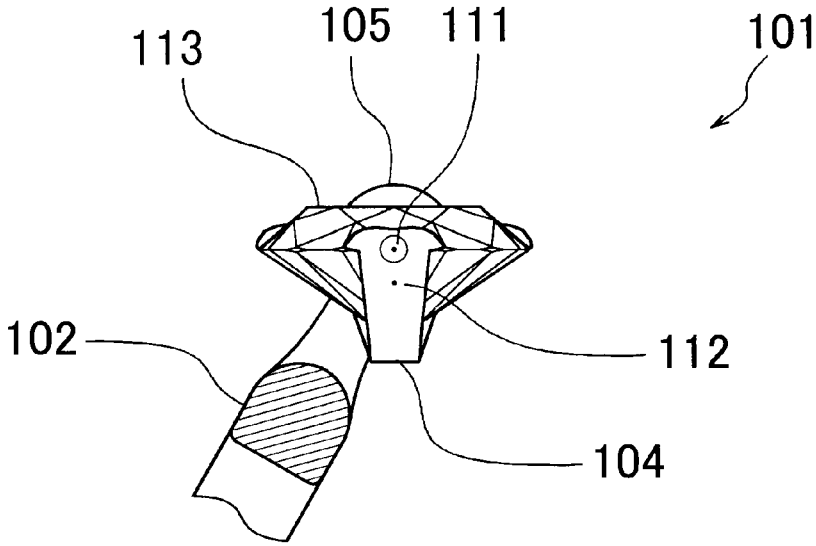
FIG. 4 is a partially cutaway view showing the essential parts of the ring in the first embodiment.

Moreover, since the positions of the struts 111 and 111 are selected in such a manner that the oscillatory center (x) connecting the struts 111 and 111 to each other is positioned above the center 112 of the entire gravity of the movable unit consisting of the stone 113 and the collet 104, the movable unit can be held in its horizontal posture by the gravity even if the ring 101 is inclined, as shown in FIG. 4.

Actually, for the ring 101 of a typical size, the weight of the movable unit consisting of the stone 103 or 113 and the collet 104 is relatively small and further, an offset from the oscillatory center (x) of the center 112 of gravity also is small. Accordingly, the movable unit can react in excellent response to a slight motion of a finger of a user, the horizontal posture can be held, and further, fine oscillation can be continued at the horizontal position and therearound.

Consequently, the stone 103 or 113, which is located at the upper portion in most cases, can sparkle in the room light or natural light with high possibility. Additionally, the attraction of the stone 103 or 113 can be exhibited to the maximum owing to a change of an optical axis caused by the fine oscillation of the movable unit (103 or 113 and 104).

Figure 2:
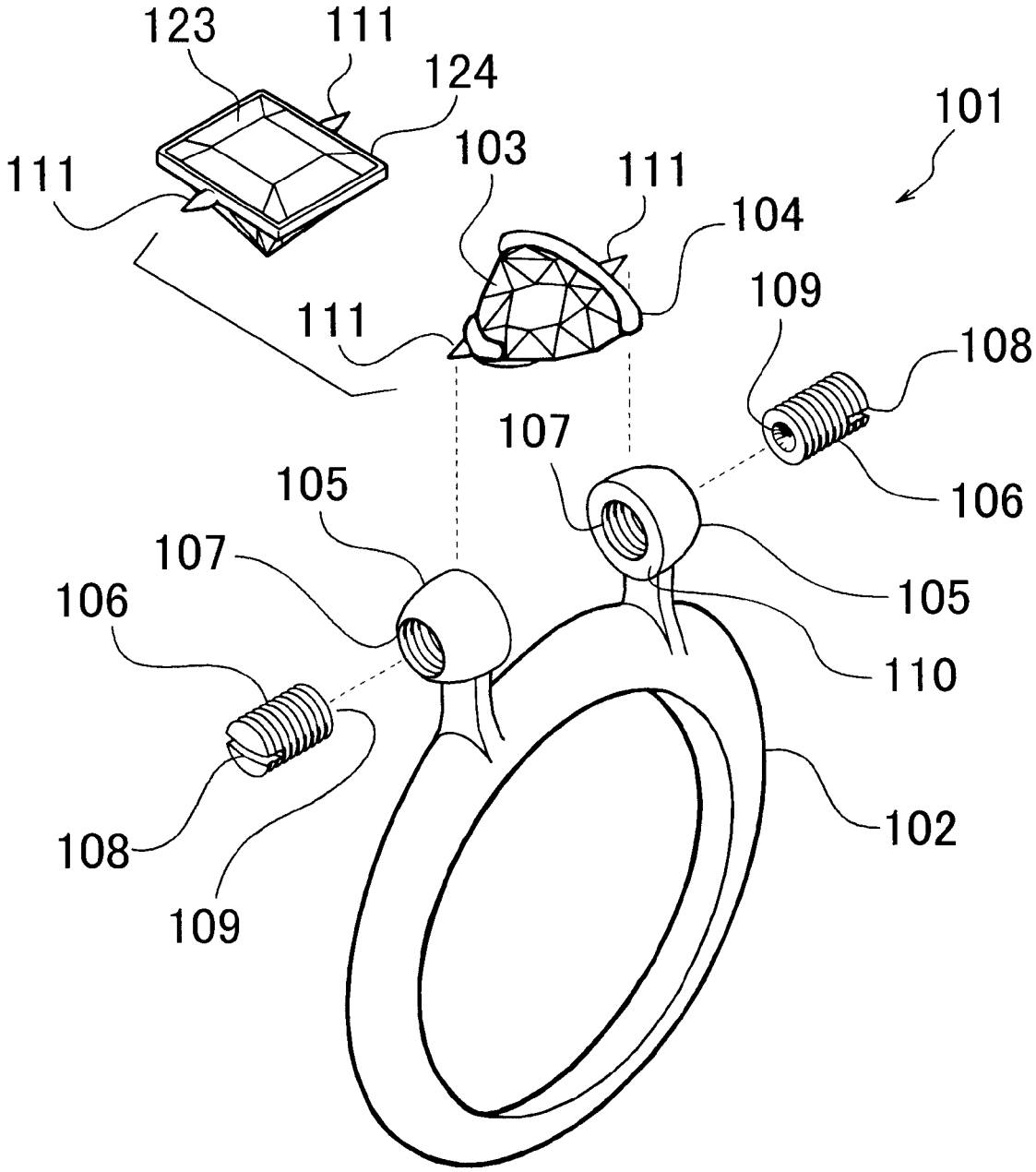
FIG. 2 is an exploded perspective view showing the ring in the first embodiment.
Figure 3:
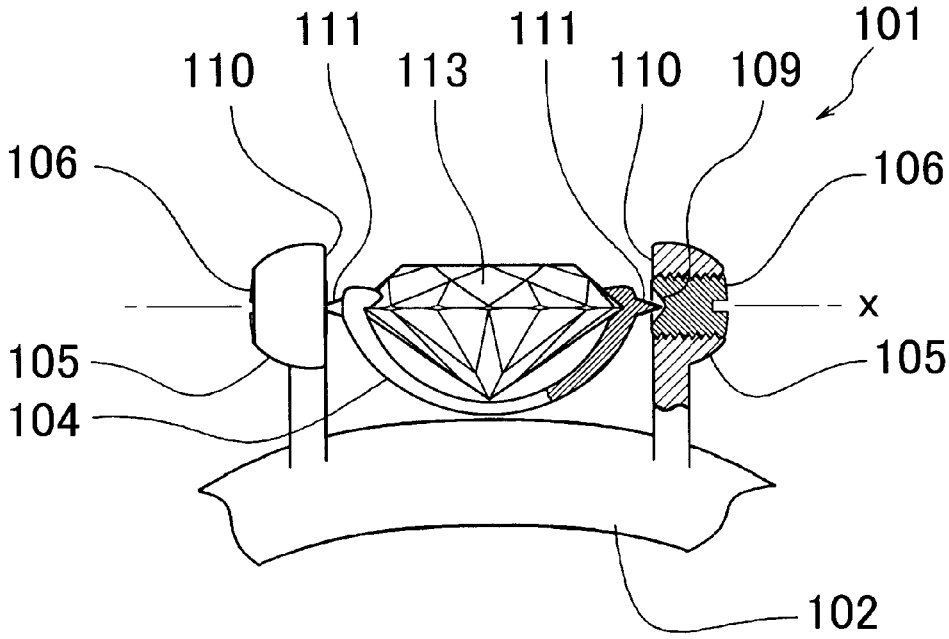
FIG. 3 is a side view partly in section showing essential parts of the ring in the first embodiment.

Furthermore, the screw 106 is loosened to be retreated outside of the support member 105, so that the stone 103 can be detached together with the collet 104, whereby the stone 103 can be replaced with another stone 123 of a different design together with another collet 124, as shown in FIG. 2.

Figure 5:
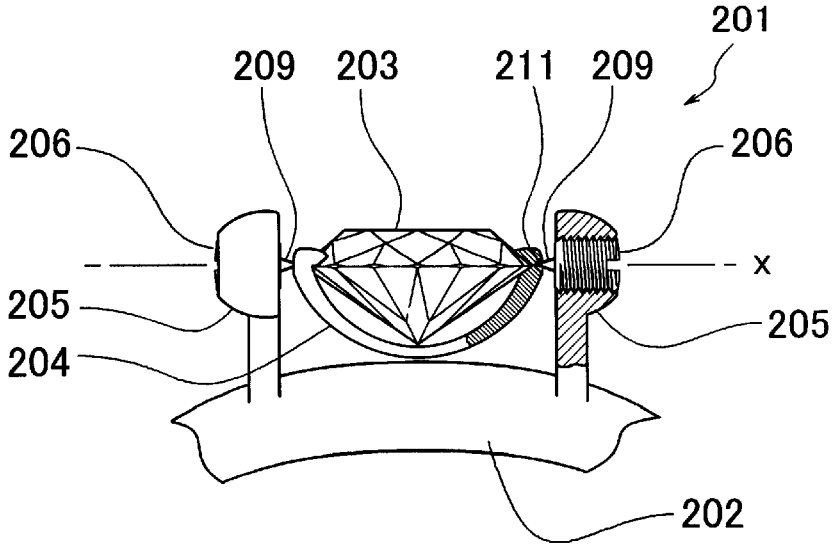
FIG. 5 is a side view partly in section showing essential parts of a ring in a second embodiment according to the present invention.

Although in the ring 101 in the above-described embodiment, the struts 111 and 111 are disposed in the collet 104 and the bearing holes 109 and 109 are formed at the screws 106 and 106, respectively, bearing holes 211 and 211 may be formed in a collet 204 and struts 209 and 209 may be disposed in screws 206 and 206, respectively, as in a ring 201 in a second embodiment shown in FIG. 5. Moreover, in each of the first and second embodiments, the bearing holes 109 and 109 or the struts 209 and 209 disposed in the screws 106 or 206 screwed in the support members 105 or 205 may be disposed in a fixed manner, that is, directly in the support members 105 or 205 without using any screw. The numeral 202 is a ring body.

Figure 6:
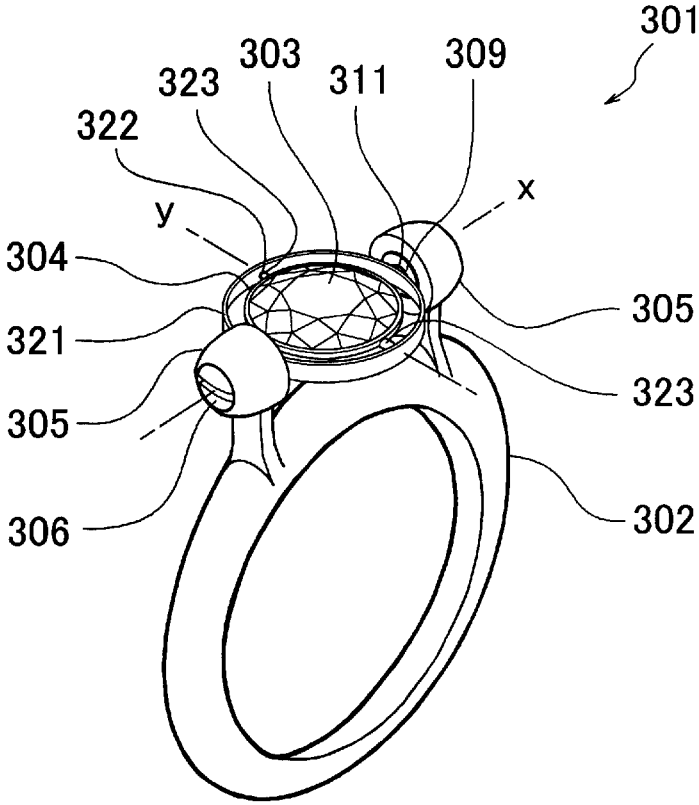
FIG. 6 is a perspective view showing a ring in a third embodiment according to the present invention.

In a ring 301 in a third embodiment shown in FIG. 6, an annular oscillating frame 321 oscillatably supported on an oscillatory axis (x) is disposed via struts 311 loosely fitted to bearing holes 309 formed at screws 306 threaded in support members 305 and 305 in the same manner as the above-described collet 104 or 204. The support member 305 is elected on a ring body 302. Bearing holes 322 and 322 are formed at opposite inner surfaces of the oscillating frame 321 along another oscillatory axis (y) perpendicular to (or crossing) the oscillatory axis (x), and then, struts 323 and 323 projecting outward from opposite outer surfaces of a collet 304 having a stone 303 fixed thereto are loosely fitted into the bearing holes 322 and 322, respectively, so that the collet 304 can be oscillatably supported on the oscillatory axis (y) with respect to the oscillating frame 321.

Consequently, a movable unit consisting of the stone 303 and the collet 304 can be oscillated in the two axial directions, i.e., in the oscillatory axes (x) and (y), and therefore, can be completely held in its horizontal posture with respect to the inclination in either one of the axial directions. Incidentally, the ring 301 in the third embodiment also may be configured such that the relationship between the bearing holes 309 or 322 and the struts 311 or 323 may be established reversely, as described above.

Since the ring according to the present invention is configured as described above, the front side of the stone is hardly hidden even if the finger is tilted, so that the stone can sparkle with increased chances, and further, the decorativeness can be exhibited by the free motion of the stone, like a necklace.

What is claimed is:

1. A gravity balancing ring for a user having a finger, the ring comprising:

a ring body to be fitted around the finger and comprising two support members erected on the ring body;

a stone; and a collect supporting and fixing the stone;

the ring body and the collect being constituted of separate members;

the collect being positioned between the two support members erected on the ring body, and being freely oscillatable in response to movement of the ring body, and being supported by loosely fitting struts projecting outward from opposite outer surfaces of the collect and coaxially with each other, into bearing holes formed at facing side surfaces of the support members, respectively; and the positions of the struts being selected in such a manner that an oscillatory center is located nearer a front side of the stone than the center of gravity of a movable unit comprising the stone and the collect.

2. The gravity balancing ring as claimed in claim 1, wherein at least one of the bearing holes formed at the facing side surface of the two support members is disposed in such a manner as to be freely advanced or retreated with respect to the corresponding support member via a screw.

3. The gravity balancing ring as claimed in claim 1, wherein at least one of the struts is formed into a conical shape, and the collect is oscillatably supported by a point contact between the strut and the inner surface of the bearing hole.

4. A gravity balancing ring for a user having a finger, the ring comprising:

a ring body to be fitted around the finger and comprising two support members erected on the ring body;

a stone; and a collect supporting and fixing the stone;

the ring body and the collect being constituted of separate members;

the collect being positioned between the two support members erected on the ring body, and being freely oscillatable in response to movement of the ring body, and being supported by loosely fitting struts projecting inward from facing side surfaces of the support members and coaxially with each other, into bearing holes formed at opposite outer surfaces of the collect, respectively; and the positions of the bearing holes being selected in such a manner that an oscillatory center is located nearer a front side of the stone than the center of gravity of a movable unit comprising the stone and the collect.

5. The gravity balancing ring as claimed in claim 4, wherein at least one of the struts formed at the facing side surface of the two support members is disposed in such a manner as to be freely advanced or retreated with respect to the corresponding support member via a screw.

6. The gravity balancing ring as claimed in claim 4, at least one of the struts is formed into a conical shape, and the collect is oscillatably supported by a point contact between the strut and the inner surface of the bearing hole.

* * * * *